United States Patent [19]

Moreno

[11] 4,453,557

[45] Jun. 12, 1984

[54] DEVICE FOR CLEANING LAMPS

[75] Inventor: Francisco M. Moreno, Madrid, Spain

[73] Assignee: Paco Moreno, S.A., Madrid, Spain

[21] Appl. No.: 435,650

[22] Filed: Oct. 21, 1982

[30] Foreign Application Priority Data

Apr. 2, 1982 [ES] Spain ..... 264.353[U]

[51] Int. Cl.[3] ..... B08B 3/02

[52] U.S. Cl. ..... 134/172; 206/229; 220/20

[58] Field of Search ..... 206/229, 223; 220/20; 134/172, 104, 135, 183, 201; 239/121, 122, 123; 51/268, 270, 424; 47/1 R, 1.7

[56] References Cited

U.S. PATENT DOCUMENTS

| | | | |
|---|---|---|---|
| 1,680,804 | 8/1928 | Remley | 206/229 |
| 3,013,656 | 12/1961 | Murphy, Jr. | 206/223 |
| 3,561,456 | 2/1971 | Stuart | 206/229 |
| 3,584,787 | 6/1971 | Thomason | 239/121 |
| 3,703,956 | 11/1972 | Oswalt | 206/223 |
| 4,052,815 | 10/1977 | Clark | 239/122 |

*Primary Examiner*—Robert L. Bleutge

*Attorney, Agent, or Firm*—Wigman & Cohen

[57] ABSTRACT

A device for cleaning lamps comprises a reservoir for cleaning liquid, equipped with a spray device to dispense a spray onto parts of a lamp to be cleaned. Surplus cleaning liquid is collected in an umbrella-like, folding, upwardly concave, water-proof screen and parts of the lamp which are not to be cleaned can be covered by water-proof bags. The entire device can be provided in a transport container and, in use, avoids the need for moving furniture away from underneath lamp fittings to be cleaned.

5 Claims, 6 Drawing Figures

DEVICE FOR CLEANING LAMPS

FIELD OF THE INVENTION

The present invention relates to a combined device for cleaning lamps, which has a utility which is greatly superior, in respect both of its rational design and of its simplicity and efficacy, to those of previously known devices for a similar purpose.

BACKGROUND OF THE INVENTION

In public places embellished with hanging lamp fittings beneath which are placed, for example, suites, other furniture, and carpets, there arises the serious disadvantage that before it is possible to proceed with the cleaning of the decorative lamp fittings to clean such lamps it is necessary first to move the furniture and carpets, which involves a great deal of work, in order that the cleaning fluids used do not stain the furnishings by splashing or dripping.

SUMMARY OF THE INVENTION

This problem is solved by the combined device of the present invention, in that it is made possible to carry out these cleaning operations on individual areas of the lamp fittings without any staining whatever of the furniture or carpets, and hence without any necessity to move these before the cleaning operation is started.

Accordingly the present invention provides a device for cleaning lamps, comprising means for applying a cleaning substance to a said lamp, means for collecting the cleaning substance applied thereby, and at least one protective element for preventing the cleaning substance from reaching specific parts of a said lamp to be cleaned, said applying means consisting of a container provided with spray dispensing means, and said collecting means consisting of a waterproof concave folding screen provided with means for suspending it from a said lamp to be cleaned. Those areas or parts which are already clean or which do not require to be cleaned can be protected by means of previously attached bags fixed with clamps. The fluid sprayed onto the lamp runs down and is collected below said lamp by the waterproof concave umbrella-like folding screen design, the stem of the frame of the collecting screen device being preferably equipped at its free end with a hook which makes it possible to hand the umbrella-like collecting device from any part of the lamp. The final drips, which could remain suspended from certain parts of the lamp, are removed by means of suitable absorbent elements.

BRIEF DESCRIPTION OF THE DRAWINGS

In order that the present invention may more readily be understood, one embodiment of the device according to the invention will now be described merely by way of example, with reference to the accompanying drawings, in which.

DETAILED DESCRIPTION OF THE PREFERRED EMBODIMENT

Figure 1:
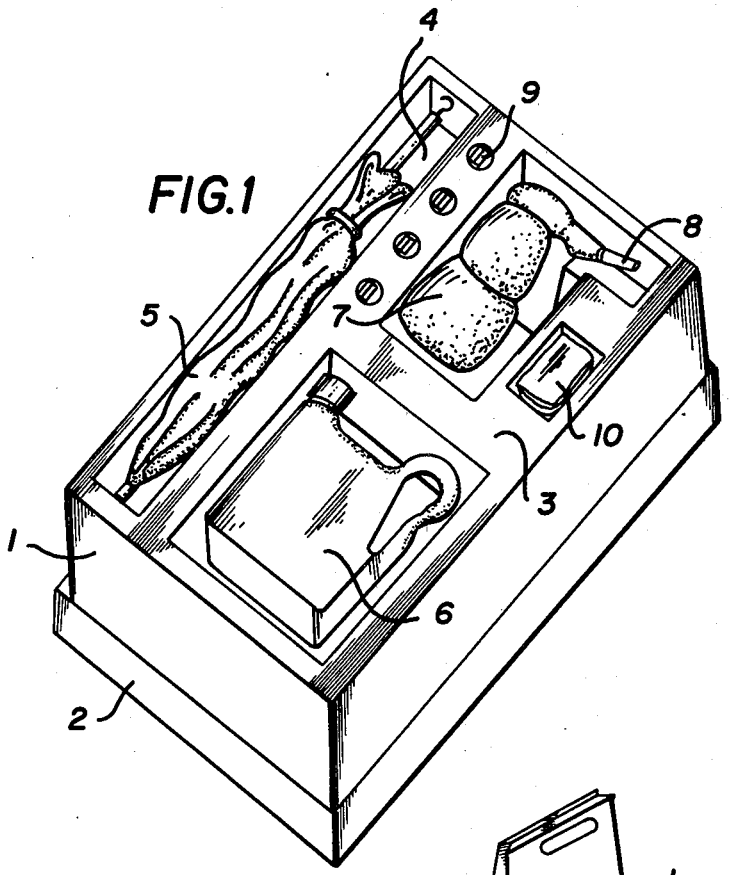
FIG. 1 shows, in perspective, a storage box for the elements making up the cleaning device of the invention.

In the drawings identical elements will be denoted by the same reference.

FIG. 1 shows a transport container 1 in the form of a box in this case having its lid 2 inverted to receive the lining material 3 in which compartments 4 for the individual components of the device are formed.

In an elongate compartment down one edge of the box is a portable liquid collecting screen device 5 comprising an umbrella-like frame and a waterproof fabric covering.

Another compartment encloses a storage can 6 to contain a supply of cleaning liquid.

An L-shaped further compartment neatly receives a cleaning fluid reservoir 7 equipped with a spray head or diffuser 8 for dispensing a spray of cleaning fluid. In use of the apparatus, the reservoir 7 can be replenished from the storage can 6.

A fourth, much smaller, compartment includes several protective bags 10 and sheets 10' of absorbent material.

A set of four still further compartments is intended to receive individual clamps 9 which can serve either to close one of the bags 10 after it has been placed over a part of the lamp which is not to be contacted by cleaning fluid, or to secure that bag to the lamp part.

Figure 2:
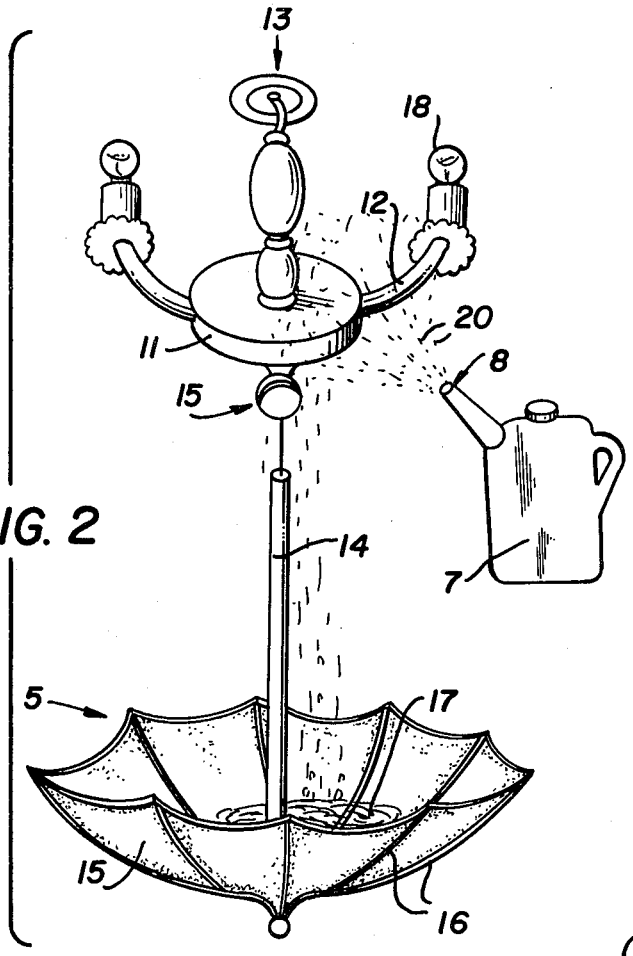
FIG. 2 illustrates schematically the cleaning of one branch of a hanging lamp.

FIG. 2 shows schematically the operation of cleaning a suspended lamp fitting comprising a central body 11 having several outwardly extending limbs 12 with individual lamps on them, the entire assembly being suspended from the ceiling or other horizontal surface by the ceiling rose 13.

In FIG. 2 the collecting screen device 5 can be seen as comprising a stem 14 having a waterproof fabric screen 15 spread over a tensioning frame comprising spokes 15 in an umbrella-like configuration. The stem 14 furthermore includes a fitting member 15' of waterproof fabric for fixing the stem to the body 11 of the lamp.

Figure 3:
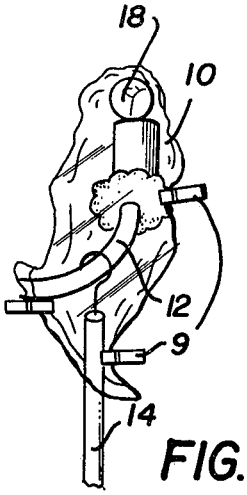
FIG. 3 shows a detailed view of the manner of protecting a light bulb, with a bag attached by three clamps.

The individual light bulbs 18, shown in FIGS. 2 and 3, are not to come into contact with the cleaning fluid so (as shown in FIG. 3) it is envisaged that one of the waterproof bags 10 will be placed over the bulb 18 and over the majority of the associated limb 12 of the lamp fitting from which, in this case, the stem 14 of the collecting screen device hangs by its fitting member 15'.

FIG. 3 shows three of the clamps 9 holding the bag in position and closing the mouth of the bag.

Figure 4:
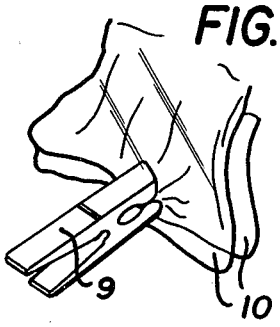
FIG. 4 shows a detailed view of the joint between the two parts of the bag, effected by one of the clamps.

FIG. 4 shows in greater detail the operation of one of the individual clamps 9 on a bag 10.

Figure 5:
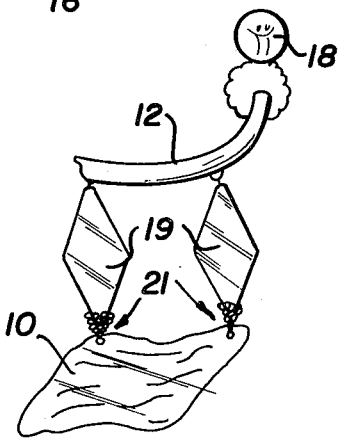
FIG. 5 shows a view of branches of the lamp from which are suspended two glass appendages, or ornaments, on which some remaining fluid is being dried by means of absorbent elements or pieces.

In FIG. 5 there is shown a pair of ornamental elements 19 suspended from the limb 12. As the cleaning liquid is likely to form drips at the bottom of each of these elements 19 and will not therefore fall clear into the screen 15 of the collecting screen device 5, one of the absorbent sheets 10 is used to wipe dry the elements 19 as shown in FIG. 5.

Figure 6:
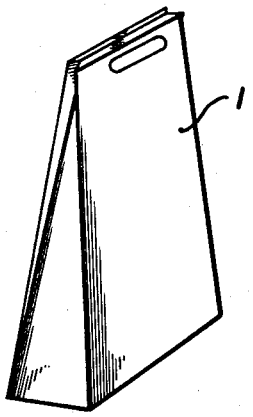
FIG. 6 shows, in perspective, another possible form of container in which the various elements making up the device according to the invention will be stored.

FIG. 6 shows an alternative form of transport container 1 which can be used to house the various components shown in FIG. 1.

In order to clean the lamp, in the manner shown in the drawings once the various elements have been removed from the container 1, the collector element 5 is opened, by being held by its stem 14, so that the ribs 16 extend to tension the waterproof fabric 15. The collector element thus opened is suspended by means of the hook 15 from any part of the lamp 13.

The cleaning fluid applying means which consists of a reservoir 7 containing the cleaning fluid and provided with a spray diffuser 8, is then used so the liquid issues through the diffuser 8 in the form of a fine spray 20 (which may be pressurised by means, not shown) applied to the various parts of the lamp which it is desired to clean.

The cleaning fluid (usually a liquid), once its cleaning function has been fulfilled, runs down and falls from the lamp to be collected at 17 in the concave zone of the umbrella-shaped collector element 16.

Before the cleaning operation is started those parts or areas 18 of the lamp which require to be protected from the action of the cleaning fluid are covered by means of bags 10 which are then closed, for example by means of clamps 9.

Once the cleaning of the lamp has been completed, an absorbent member 10, for example a pad of absorbent fabric, is passed over those ornamental elements 19 to which any drips 21 of cleaning fluid may have remained attached through not having fallen into the collector element 16.

As may be understood, various modifications of detail may be introduced into the embodiment described without thereby departing from the scope of the present invention as defined by the following claims.

I claim:

1. A device for cleaning lamps, comprising means for applying a cleaning substance to a said lamp, means for collecting the cleaning substance applied thereby, and at least one protective element for preventing the cleaning substance from reaching specific parts of a said lamp to be cleaned, said applying means consisting of a container provided with spray dispensing means, and said collecting means consisting of a waterproof concave folding screen provided with means for suspending it from a said lamp to be cleaned.

2. A device according to claim 1, wherein the screen constituting the collecting means consists of a waterproof sheet attached to a folding umbrella-like framework whose central stem terminates at its free end in a hook constituting said means for suspending the collecting screen from a said lamp.

3. A device according to claim 1, wherein said protective means consists of one or more bags of flexible and waterproof sheet material, and clamping means for closing said bags around the lamp parts to be protected.

4. A device according to claim 1, wherein said collecting means further includes at least one absorbent member for removing residual cleaning fluid suspended from said at least one lamp part as a drip of liquid.

5. A device according to claim 1, and including a transport container having storage compartments for housing said collecting means and said cleaning substance applying means.

* * * * *